US005592964A

United States Patent [19]

Traylor

[11] Patent Number: 5,592,964

[45] Date of Patent: Jan. 14, 1997

[54] AIR GAP ANTI-SIPHON SYSTEM

[76] Inventor: Paul L. Traylor, 16591 Milliken Ave., Irvine, Calif. 92714

[21] Appl. No.: 289,137

[22] Filed: Aug. 11, 1994

[51] Int. Cl.[6] ..... E03C 1/12

[52] U.S. Cl. ..... 137/216; 137/216.1; 137/360

[58] Field of Search ..... 137/216, 216.1, 137/360; 138/44; 285/132

[56] References Cited

U.S. PATENT DOCUMENTS

| | | | |
|---|---|---|---|
| 2,047,163 | 7/1936 | Cekal | 137/216 |
| 2,056,357 | 10/1936 | Luff | 137/216 |
| 2,161,204 | 6/1939 | Shanley | 137/216 |
| 2,878,826 | 3/1959 | Dolenga | 137/216 |
| 3,183,923 | 5/1965 | Henrikson | 137/216 |
| 3,411,524 | 11/1968 | Raine et al. | 137/216 |
| 3,716,143 | 2/1973 | Clark . | |
| 3,786,924 | 1/1974 | Huffman . | |
| 3,820,571 | 6/1974 | Grier | 138/44 |
| 3,856,672 | 12/1974 | Boswinkle et al. . | |
| 3,929,149 | 12/1975 | Phillips | 137/216 |
| 4,071,445 | 1/1978 | Katayama et al. . | |
| 4,105,721 | 8/1978 | Schliebe | 138/44 X |
| 4,454,891 | 6/1984 | Dreisbelbis et al. | 137/216 |
| 4,646,775 | 3/1987 | Traylor | 137/216 |
| 4,771,485 | 9/1988 | Traylor | 137/216 |
| 4,812,237 | 3/1989 | Cawley et al. . | |
| 4,856,121 | 3/1989 | Traylor | 137/216 |
| 4,917,847 | 4/1990 | Solomon . | |
| 4,944,877 | 7/1990 | Maples . | |
| 4,967,784 | 11/1990 | Barhydt, Sr. et al. | 137/216 |
| 5,006,234 | 4/1991 | Menon et al. . | |
| 5,159,958 | 11/1992 | Sand | 137/888 |
| 5,176,165 | 1/1993 | Traylor | 137/216 |
| 5,253,677 | 10/1993 | Sand | 137/888 |
| 5,305,778 | 4/1994 | Traylor | 137/216 |

FOREIGN PATENT DOCUMENTS

| | | | |
|---|---|---|---|
| 194078 | 1/1908 | Germany | 137/801 |

*Primary Examiner*—Gerald A. Michalsky
*Attorney, Agent, or Firm*—Joseph F. McLellan

[57] ABSTRACT

An air gap anti-siphon system designed for high flow rate drainage of waste water from household water softeners and the like, but adapted to be converted for low flow rate drainage of waste water from household reverse osmosis units. The system includes escape passages to shunt to atmosphere any backflow from the drain system.

15 Claims, 6 Drawing Sheets

AIR GAP ANTI-SIPHON SYSTEM

BACKGROUND OF THE INVENTION

1. Field of the Invention

The present invention relates to an air gap anti-siphon system designed for high flow rate drainage of waste water from a household water softener system or the like, but modifiable for low flow rate drainage from a reverse osmosis system.

2. Description of the Prior Art

A typical household water softener continuously treats incoming water by passing it through a resin composition. Water flow through the composition is periodically interrupted so that the resin composition can be flushed with salt water to rejuvenate it. The flow of waste or reject salt water coming out of the resin composition is turbulent and at a relatively high rate. In contrast, the discharge from a typical household reverse osmosis system is at a relatively low rate. At present there is no satisfactory air gap anti-siphon system that is useful for use with a water softener system, and yet which is easily convertible for use with a reverse osmosis system.

Air gap anti-siphon devices of the prior art are generally incapable of blocking sudden sewage backflow, which can occur when either a vacuum or sufficiently low pressure develops in the household lines, or a high pressure develops in the sewer lines, or both. Any sewage backflow into the water softener system or the reverse osmosis system is extremely undesirable because there is then a potential entry point into the potable water system of the household.

The height of air gap specified by most plumbing codes to prevent back siphoning of waste water is usually one inch or more. This is normally adequate to prevent siphoning of relatively slowly rising backflows, but it is not adequate to prevent a high velocity stream of contaminated water from bridging the air gap when a sudden pressure differential develops.

Backflow prevention devices are described in my U.S. Pat. No. 5,176,165. These prevent contamination of household water systems that are associated with the relatively slow flow rate reverse osmosis systems. However, they are not effective in handling the high flow rates associated with a water softener system.

An earlier backflow prevention device effective to handle high flow rates is disclosed in U.S. Pat. No. 3,411,524, entitled "Vacuum Breaker", issued Nov. 19, 1968 to Robert E. Raine and to the present applicant. However, the device is incapable of conversion for use with the low flow rates of reverse osmosis systems. Also, the design makes it almost impossible to install in washing machine outlet boxes of the type now being used.

SUMMARY OF THE INVENTION

According to the present invention, an air gap anti-siphon system is provided which includes an air gap device to prevent backsiphoning and backflow at either low or high waste water flow rates, depending upon how it is configured. It can also be configured to shunt to atmosphere any high velocity backflow from the sewage lines, and it may also include a back flow resistor to block such backflow.

The system includes water conditioning or stream shaping elements known in the prior art to control and shape water flowing through the system. Shaping the stream increases the system water flow capacity for given sizes of conduits, and substantially eliminates water spatter out of the opening in the air gap device.

The components of the system are preferably made of corrosion resistant, inexpensive molded plastic material. The end fittings are easily attachable to existing household plumbing conduits. In particular, the air gap device can be fitted within a washing machine outlet box in a manner known in the prior art. It can also be configured and supported to empty into relatively small diameter drain standpipes.

Different water shaping elements or stream controls can be substituted to adapt the system for use with either high flow rate water softeners or slow flow rate RO devices. Drain flow capacity is enhanced and water spatter out of the air gap component of the system is prevented.

The present air gap anti-siphon system is readily adapted to be after-fitted to household systems not having effective anti-siphon systems, and the system components are relatively inexpensive, and quickly and easily installed.

Other features and advantages of the invention will become apparent from the following detailed description, taken in conjunction with the accompanying drawings which illustrate, by way of example, the features of the invention.

BRIEF DESCRIPTION OF THE DRAWINGS

FIG. 3 is an enlarged cross-sectional view of that portion of the system illustrated in FIG. 1 which is located upstream of the backflow resistor, and particularly illustrating the prior art high flow rate stream control and air gap devices;

FIG. 4 is a view taken along the line 4—4 of FIG. 3;

FIG. 5 is a view similar to FIG. 4, but illustrating a modification of the stream control device according to the present invention to accommodate slow rate waste water flow from a household reverse osmosis unit or the like;

DESCRIPTION OF THE PREFERRED EMBODIMENTS

Figures 1, 2:
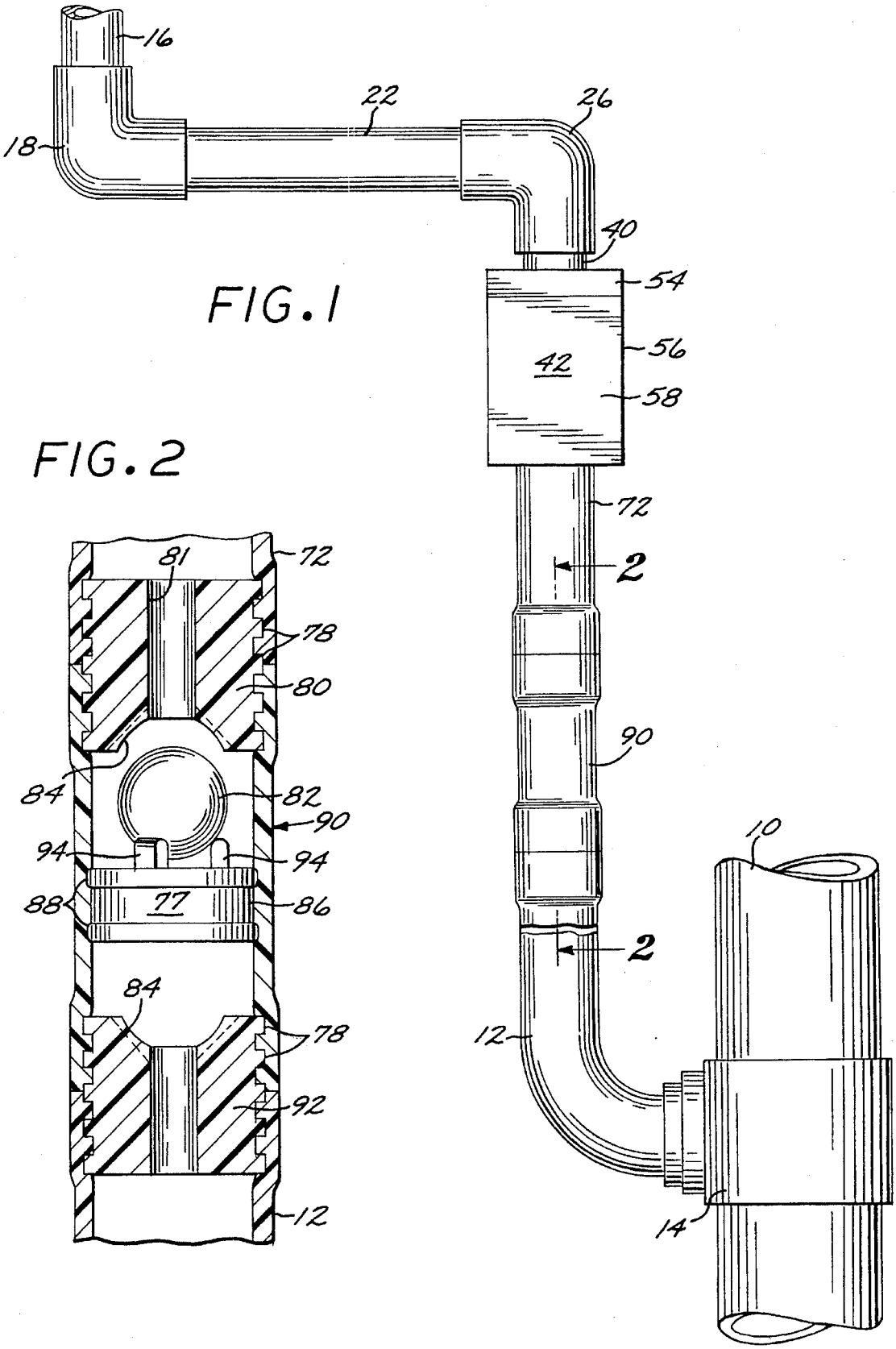
FIG. 1 is a schematic view of the present air gap anti-siphon system incorporating a known or prior art air gap, as it would appear when draining waste water from a water softener or the like for discharge into a household sewer system drain line.
FIG. 2 is an enlarged view taken along the line 2—2 of FIG. 1, particularly illustrating the backflow resistor.

Referring now to the drawings, and particularly to FIGS. 1–4, one embodiment of the present anti-siphon system is illustrated as it would appear when connected between water treatment apparatus such as a water softener (not shown) and a conduit or drain pipe 10 located beneath a kitchen sink (not shown). It should be, understood that the system forms part of the prior art, except for the addition of a downstream check valve, and modifications to the air gap body, as will be seen.

As seen in FIG. 1, the prior art system is connected in known manner to the drain pipe 10 by flexible plastic tubing 12 that is clamped onto the drain pipe 10 by a cylindrical fitting 14. The drain pipe 10 includes an opening (not shown) through which water can pass from the tubing 12. A suitable pressure seal (not shown) clamps onto the tubing 12 and drain pipe 10 to prevent water from leaking out of the fitting 14.

The drain pipe 10 is typically connected downstream to a conventional "P" trap (not shown) that empties into the household sewage system (not shown).

Reject or waste water from the household water softener flows into a conduit 16. Like most of the system components and connections, the conduit 16 is made of polyvinyl chloride (PVC) or other suitable rigid or flexible plastic material.

Figures 3, 4, 5:
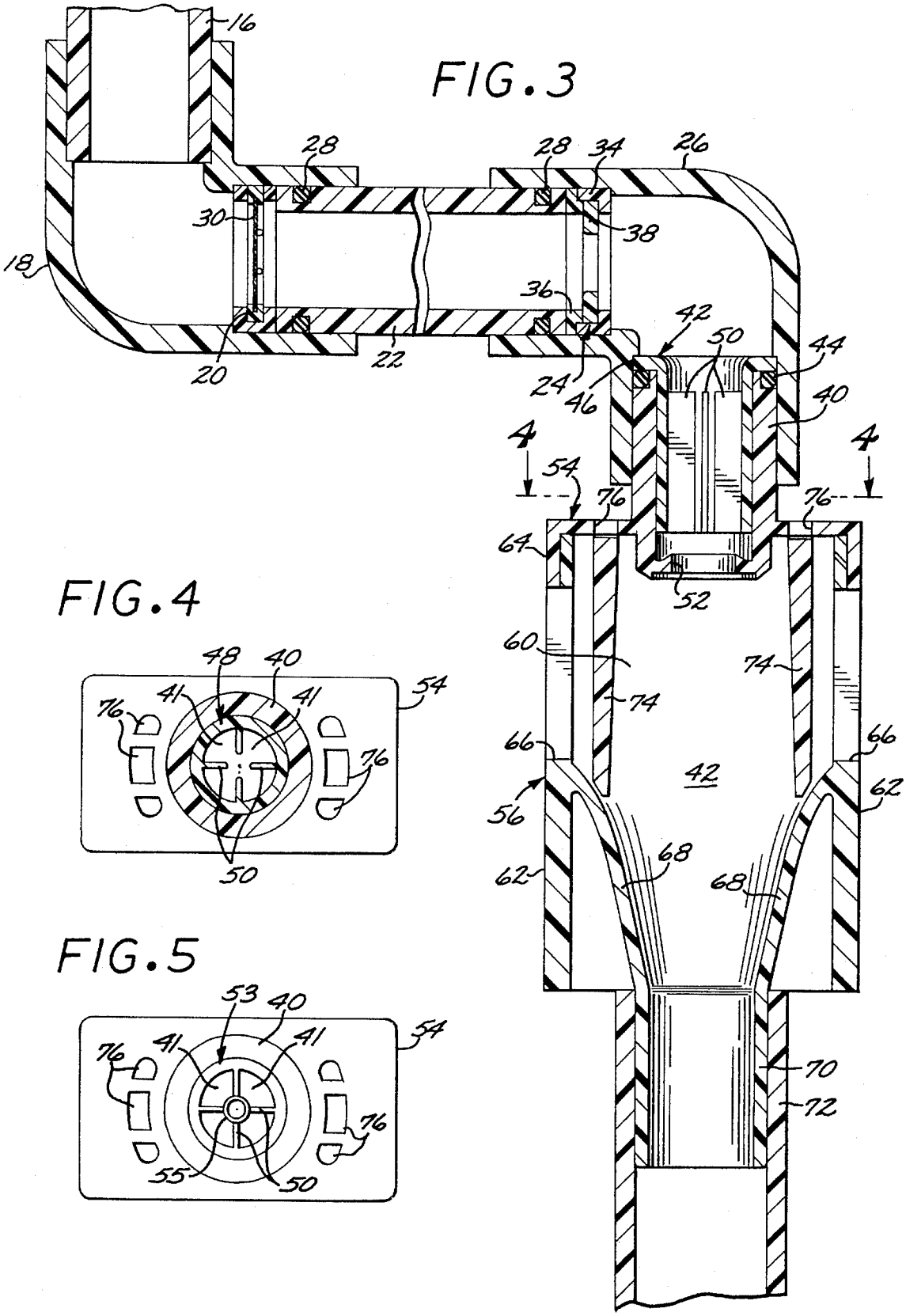

As seen in FIG. 3, conduit 16 fits into and is preferably adhesively secured within an elbow 18, butting up against an internal shoulder of the elbow.

Butting up against an internal shoulder of the other leg of the elbow 18 is an assembly which comprises a screen fitting 20, an elongated cylindrical connector 22, and a flow control fitting 24. The components of the assembly all have the same outside diameter so that one end of the assembly can slidably fit within the elbow 18, and the other end can slidably fit within the leg of an elbow 26.

The opposite extremities of the connector 22 include annular grooves which receive sealing O-rings 28. These provide a watertight fit between the connector 22 and the elbows 18 and 26.

Screen fitting 20 is an annular, centrally apertured element having a laterally opening screen receiver slot to receive a screen element 30. Fitting 20 is trapped between an internal shoulder of the elbow 18 and the end of the connector 22 so that the screen element 30 is in position to capture sand and grit before they enter the downstream components of the present system.

The flow rate of water from the water softener to the conduit 16 is relatively high, and relatively turbulent because of the changes in stream direction caused by the short runs and sharp turns of the input conduits. The flow rates are typically between six and nine gallons per minute.

The flow control fitting 24 is trapped or held between an internal shoulder of the horizontal leg of the elbow 26 and an end of the connector 22. Fitting 24 is centrally apertured and includes a peripheral flange 34 that complementally fits within an annular flange of a keeper 36. A flow control wafer or element 38 is trapped between them.

Flow control element 38 is sized and configured to provide the rate of water flow desired. As will be apparent, different flow control elements can be substituted to achieve whatever flow rate is desired.

The vertical leg of elbow 26 slidably receives a cylindrical upper connecting portion 40 of an air gap device 42. The upper portion 40 includes an annular seat for a sealing element or O-ring 44 which is trapped or compressed in position between the seat, the elbow 26, and an upper peripheral flange 46 that fits against the elbow 26. This establishes a fluid tight relation between the elbow 26, the upper connecting portion 40, and the flange 46.

Flange 46 is part of a water flow conditioner or stream control 48 which straightens or shapes the stream of water flowing through the air gap device 42. The stream control 48 includes a tubular body slidably sleeved within the cylindrical interior of the upper connecting portion 40 in coaxial relation. In addition, as seen in FIG. 4, the interior walls of stream control portion 48 include a plurality of radially inwardly directed vanes or fins 50. These fins 50, which in one embodiment are about one inch long, and the interior walls of the portion 48 define four vertically or longitudinally directed passages 41. The passages 41 control and shape the stream of water flowing through portion 48, which is important because of the relatively high rate of flow and turbulence which characterizes waste water flow from a household water softener.

The base of portion 40 includes a central opening 52 smaller in diameter than the interior of portion 40. The reduction in size is from about 0.675 inches to 0.375 inches, which produces a higher velocity jet or stream of shaped water for passage through the interior of the air gap device 42. The jet is a focused and straight flowing stream that is nonturbulent and smooth. No spattering of the stream occurs.

Other than the improved structure of the stream control 48 and the air gap device 42, the drain structure from the conduit 16 is known in the art for high flow applications such as water softener systems.

Figure 6:
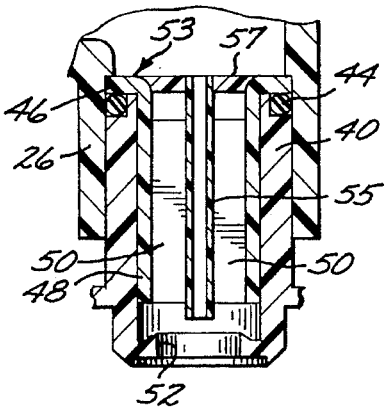
FIG. 6 is a longitudinal cross sectional detail view of the stream control device of FIG. 5, illustrating the centering disk at the top.

In FIGS. 5 and 6 a modified stream control 53 is illustrated which is a modification of the structure of FIG. 4 for handling the relatively low flow rate water streams that are discharged from a typical reverse osmosis (RO) unit. Most RO flows are much less than half a gallon per minute.

Stream controls 48 and 53 can, if desired, both be marketed in one kit. The installer can then select the proper control, depending upon whether a high-flow water softener application or a low-flow RO application is involved. Alternatively, the proper components could be installed at the factory and fixed in position using adhesive or the like.

In the stream control 53 the water conditioning or stream shaping is done by passing the water stream through a small diameter section of hollow tubing 55, such as ⅛ inch flexible polyethylene plastic tubing. The tubing is inserted in the longitudinal space defined between the ends of the fins 50, as best seen in FIG. 5. The fit is relatively snug, and the radially inwardly disposed edges of the fins 50 bear against and support the tubing 55. This straighten the otherwise curvilinear tubing 55.

Additional support is provided by passing the upper end of the tubing 55 through a central opening in disk 57 which is press fitted within the upper or entry throat portion of the stream control 53.

The disk 57 blocks the slowly flowing stream of RO water, forcing it to pass through the tubing 55. This shapes the RO water into a well defined jet or stream which passes through the air gap device 42 without dribbling or spattering.

Figure 7:
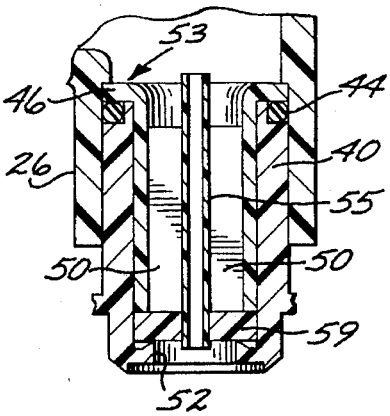
FIG. 7 is a view similar to FIG. 6, but illustrating the centering disk at the bottom.

FIG. 7 illustrates an arrangement that is similar to that of FIGS. 5 and 6. The disk 57 is omitted, a larger diameter disk 59 is substituted, and the lower end of the tubing 55 is passed through a central opening in the disk 59. The disk 59 is press fitted within the portion 40 and, if desired, may be adhesively secured in position to the base of portion 40 in overlying and sealing relation to the control opening 52. The lower ends of the fins 55 bear against the disk 59 to hold it in position.

The disk 59 acts much like the disk 57 in that it forces the low flow rate RO water to flow through the tubing 55, shaping the water into a solid non-spattering jet or stream.

To accommodate a greater volume flow of RO water, a plurality of the tubing sections 55 (not shown) can be fitted in the spaces between the fins 50 in communication with a corresponding number of openings in the disk 57 or 59, as the ease may be.

Figure 8:
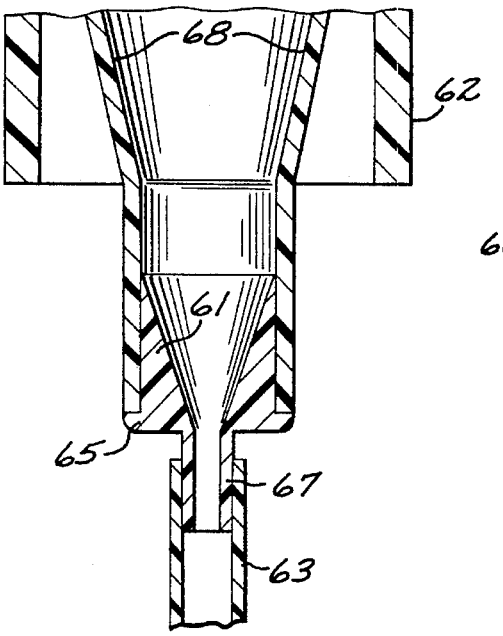
FIG. 8 is a longitudinal cross sectional detail view illustrating special funnel shape water directing walls.

FIG. 8 illustrates another embodiment of a water flow conditioner or stream control 61. It is particularly adapted to efficiently collect and drain away the drip flow of waste water which characterizes most RO units. When used in combination with upstream elements (53, 50, 55) or (59, 50, 55), the stream control 61 increases flow from about one-half gallon per minute to about two and one-half gallons per minute in a predetermined size of drain line 63. Instead of backing up and flooding out, the dripping RO discharge is shaped into a stream of higher velocity that is capable of flowing through the drain line 63 faster than the flow of uncontrolled water droplets.

The cylindrical stream control 61 is press fitted into the connecting section 70, and a circular flange 65 of the body 61 butts up against the lower end of the portion 70. Integral with the flange 65 is a tube 67 which fits tightly within the drain line 63.

The interior surface of the main body of the stream control 61 is conical to collect and smoothly direct water into the tube 67. The water emanates frown the tube 67 in a smooth stream to maximize the RO water flow capacity of the system.

In the known air gap device 42 seen in FIG. 3, the lower extremity of the portion 40 is integral with a transverse, removable and generally rectangular cap 54 that forms the upper wall of a body 56. The body 56 includes front, rear and side walls 58, 60, and 62. The upper ends of the side walls 62 include a peripheral recess or shoulder which receives a complemental, depending flange 64 of the cap 54 in a removable, tight fitting relation. In most case the cap 54 is adhesively secured in position.

The side walls 62 are each provided with an air gap or vertical opening 66 at least one inch high in order to vent the interior of the body and prevent back siphoning of waste water upwardly through the body. The size and configuration of the openings 66 can be varied as required.

The body 56 adjacent the lower terminus of each of the openings 66 includes a pair of confronting, inwardly and downwardly sloping water directing walls 68. These converge and become integral with a cylindrical lower connecting portion 70 having approximately the same outside diameter as the upper connecting portion 40. The portion 70 is tightly received within flexible rubber or plastic drain tubing 72.

With the foregoing prior art arrangement utilizing the air gap device 42, the relatively rapidly flowing turbulent water from the water softener is initially calmed by the screen element 30. Its rate is controlled by the flow control element 38, and it then passes into the smoothly faired entry throat of the water flow conditioner or stream control 48. The control 48 produces a shaped, relatively high velocity jet of water which flows past the air gap openings 66 and into the tubing 72.

As previously indicated, the shape and velocity of the water jet substantially prevents water from spattering out of the openings 66. Such spattering is further prevented by a pair of elongated fins or spatter shields 74. These are integral with the cap 54 and extend downwardly to overlie the openings 66, respectively. The lower ends of the shields 74 terminate adjacent the water directing walls 68. The shields 74 are thus positioned to block the path of spattering water out of the openings 66.

Figure 10:
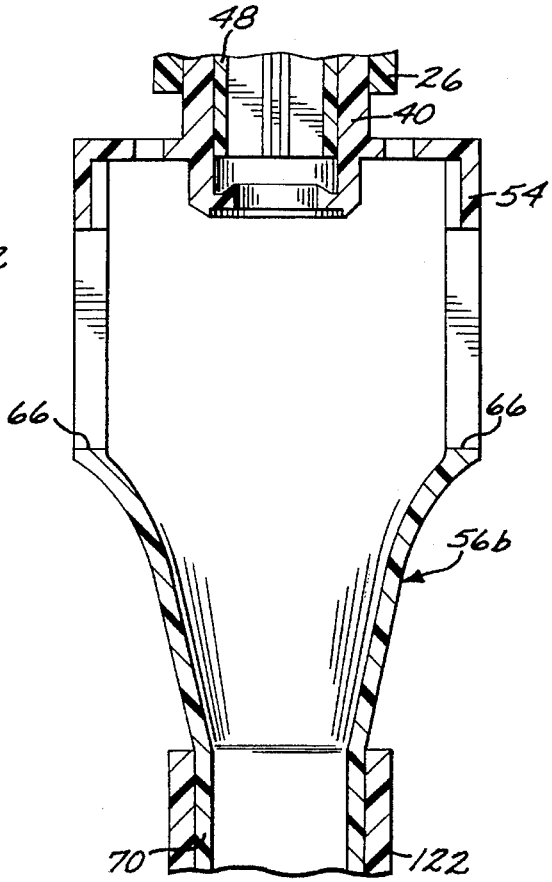
FIG. 10 is a cross-sectional view similar to that of FIG. 9, but illustrating another embodiment of the air gap, wherein the side walls of the air gap body have been eliminated.

In some instances plumbing inspectors want to see through the openings 66 and do not want the shields 74 in the way. If that is the case, the upper ends of the shields 74 can be broken away from the cap 54 in a known manner by striking them with a pointed tool (not shown) inserted into the openings 76 molded through the top of the cap 54. The removal of the shields 74 is illustrated in FIG. 10.

As illustrated in FIG. 2, a back flow resistor 77 is included in the system of FIG. 1. In particular, the lower end of the drain tubing 72 is fitted over the gripping ridges 78 of an inlet connector 80 which forms the upper part of the backflow resistor 77.

The backflow resistor 77 comprises a shaped element in the form of a ball 82 which is movable upstream to check or resist backflow upon engagement with a seat 84 of the inlet connector 80. This closes off a central passage 81 of the connector 80. In its normal downstream position the ball 82 is supported by a circular, centrally bored retainer 86.

The retainer 86 includes enlarged circumferential ridges 88 to retain it in position after it has been force fitted within a section of tubing 90. The upper end of the tubing 90 is forced over the ridges 78 of the inlet connector 80, and its lower end is similarly forced over ridges 78 of an outlet connector 92. The outlet connector 92 is identical to the inlet connector 80, except that it is reversed in position so that its seat 84 faces in an upstream direction. The identical construction is simply for convenience so that only one part has to be stocked.

The downstream extremity of the outlet connector 92 is similarly forcibly fitted over the upstream end of the tubing 12 to complete the How path to the drain pipe 10. It will be apparent that the check valve assembly is thus easily located and installed in a continuous length of drain tubing by simply cutting the tubing and inserting the inlet and outlet connectors within the cut ends, and fitting the section of tubing 90 in position with the enclosed ball 82 and retainer 86.

The retainer 86 includes three radially extending, circumferentially spaced apart ribs or support posts 94. The posts 94 support the ball 82 during normal downward water flow past the ball and between the posts 94.

The backflow resistor 77 is configured to accept a suitable screen similar to the screen 30 shown in FIG. 3. This keeps foreign material in any waste water backflow from interfering with the proper seating of the ball 82 against the seat 84. Also, the resistor 77 includes a coarse screen (not shown) similar to the coarse screen illustrated in FIG. 31 of my U.S. Pat. No. 5,305,778. The coarse screen is fitted within the retainer 86. This prescreens relatively coarse portions of any backflowing foreign matter.

Figure 9:
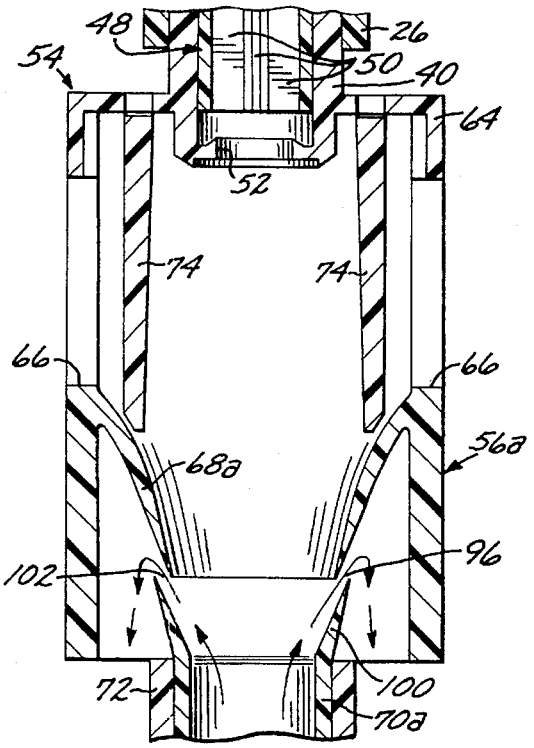
FIG. 9 is a cross-sectional view similar to that of FIG. 3, but illustrating a modified embodiment of the air gap device according to the present invention.
Figure 11:
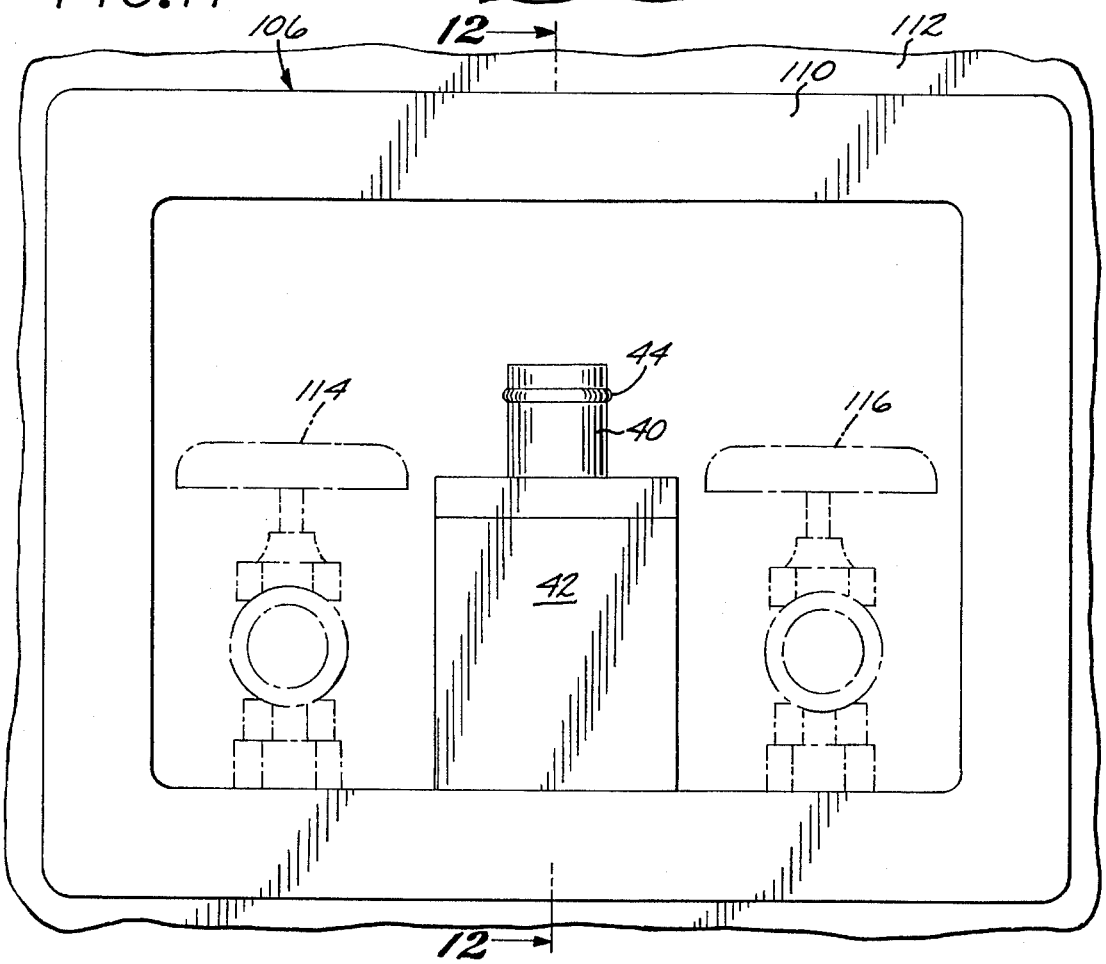
FIG. 11 is a front elevational view of the known manner of mounting the prior art anti-siphon device of FIG. 3 in a typical washing machine wall box.

Such a downstream backflow resistor 77 is not normally used in potable water systems. This is because such a device is susceptible to possible clogging by foreign matter in any waste water backflow. However, such a resistor 77 is a practical way to block a surge or high velocity backflow and, according to the present invention, this desirable characteristic can be taken advantage of when the resistor 77 is used in conjunction with an air gap device like that of FIG. 9. That device includes a modified body 56*a* identical to the body 56*a* of FIG. 3, except for laterally directed openings or shunt passages 96 in its water directing walls 68. These allow any slowly rising water passing through any clogged resistor 77 to be shunted to atmosphere through passages 102, or to spill out of openings 66.

The water directing walls 68*a* terminate a predetermined distance above the upper end of the tubing 72 to define a connecting portion 70*a*. The portion 70*a* diverges radially outwardly above the tubing 72 to form a cylindrical shunting or diverlet wall 100 that is larger in diameter than the lower cylindrical termination of the water directing wall 68*a*. This defines the annular escape passage 102 previously mentioned, which provides a path for slowly rising waste water backflow, as indicated by the arrows.

Figure 12:
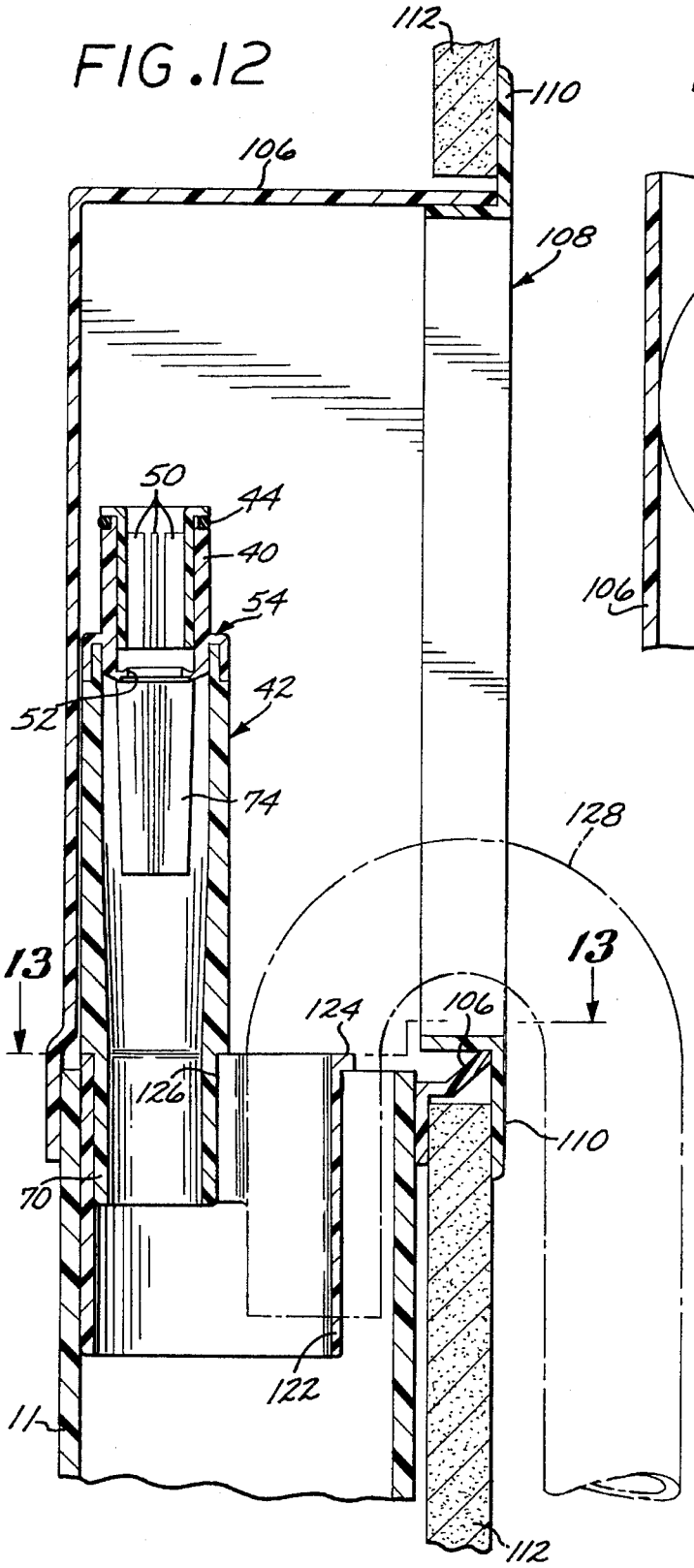
FIG. 12 is a view taken along the line 12—12 of FIG. 11.
Figure 13:
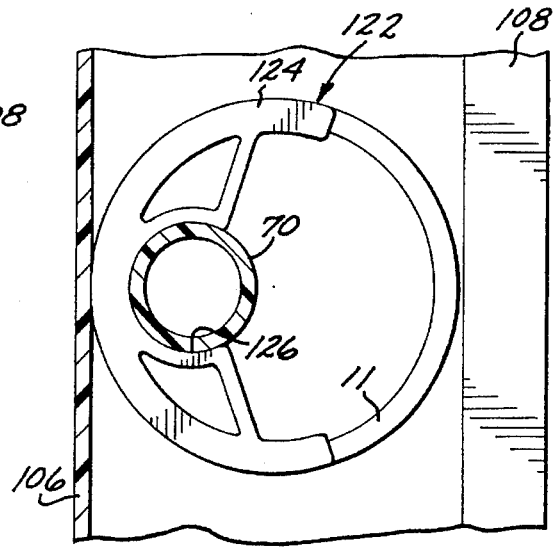
FIG. 13 is a view taken along the line 13—13 of FIG. 12.

The body 56*b* of FIG. 10 is adapted, like the prior art body 56 of FIG. 3, for mounting to a drain standpipe 11 through the use of a clamping element 122. This is illustrated in FIGS. 12 and 13. The walls 62 shown in the embodiment of FIG. 3 have been eliminated. This allows waste water flowing up and out of the standpipe 11 (FIG. 13) to be shunted laterally outwardly by the outer surfaces of the water directing walls 68. The backflow thereby tends to flow exteriorly of the air gap anti-siphon device before it comes into contaminating contact with the upper connecting portion 40.

The present air gap anti-siphon system thus not only includes waste water shunt or escape passages 102, but also includes a backflow resistor to protect the system from contamination by high velocity backflows.

The anti-siphon system can be conveniently packaged in a kit for original installation with a water softener or RO water treatment system, or it can be sold as an after market system.

FIGS. 10–13 illustrate the present system installed in a washing machine wall outlet or box 106. Such wall boxes are used by many building contractors to conceal the connections between a washing machine and its water inlets and its drain hose.

The box 106 is usually made of plastic molded into a rectangular shape. An escutcheon or trim ring 108 is provided that has a lip or flange 110. This overlies the margins of the recessed opening cut in the adjacent wall 112 for mounting the wall box.

Hot and cold water faucets 114 and 116 and the drain line or standpipe 11 are all recessed within the wall 112. These are received within openings molded in the walls of the box 106, as illustrated. The standpipe can be metal pipe, but it is typically made of a plastic material having a smooth upper edge.

The lower connecting portion 70 of the anti-siphon device 42 is securely held adjacent the rearward inner surface of the standpipe by a relatively resilient clamping element 122. The element 122 has an outer diameter slightly larger than the inner diameter of the standpipe, which is typically about two inches. The element 122 is compressible sufficiently to reduce its outside diameter so that it can fit in the standpipe 11. The upper end of the element 122 includes a flange 124 which engages the upper edge of the standpipe 11 to seat the element 122 in position.

As seen in FIG. 13, the element 122 includes an areuate central section 126 having an opening on its front side to receive the lower connecting portion 70 of the anti-siphon device 42. Escape passages 127 are located on opposite sides of the section 126. Once portion 70 is inserted, squeezing or compression of the element 1.22 allows it to be fitted within the standpipe 11. On release of the compression, the connecting portion 70 fits snugly against the standpipe 11.

Portion 70 and element 122 occupy approximately half the opening in the standpipe, the remaining room being largely occupied by the usual washing machine drain hose 128. In this situation, use of the air gap body 56*b* of FIG. 10 allows any high velocity backflow of sewage to be laterally shunted to the outside.

Figure 14:
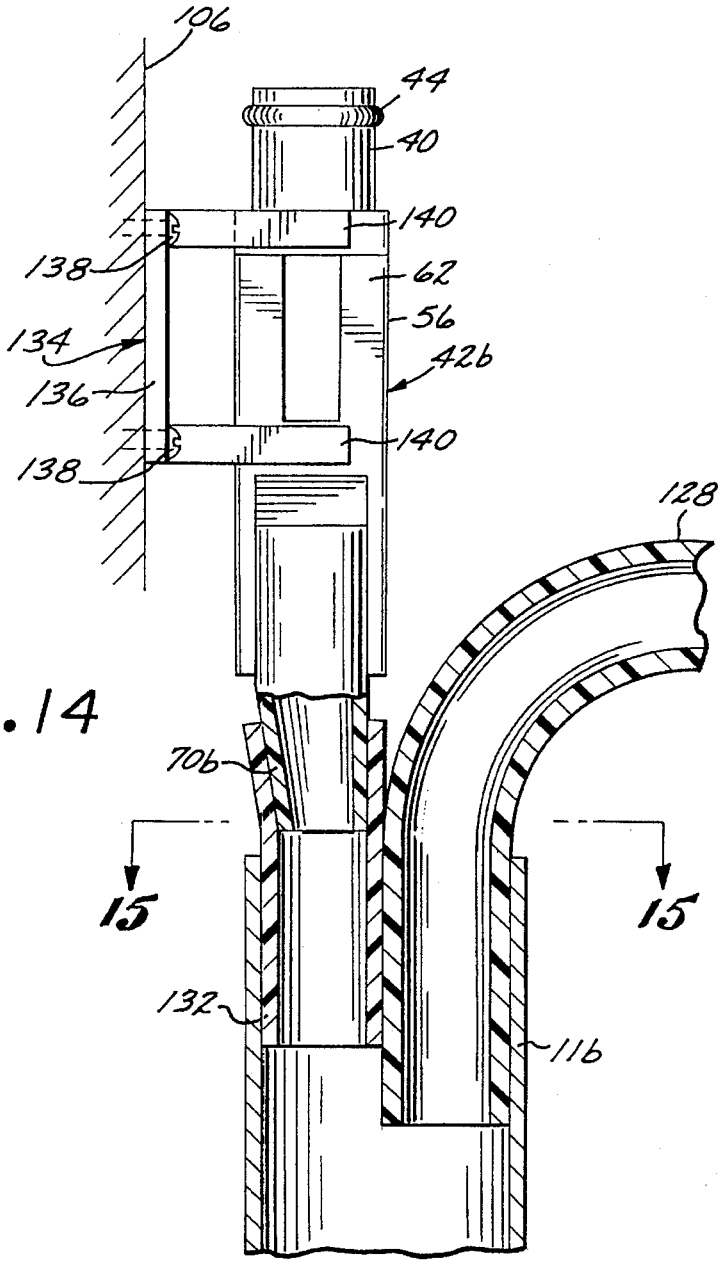
FIG. 14 is a partial side elevational view similar to that of FIG. 12, but illustrating another embodiment of the air gap body configured to better fit within a smaller diameter drain standpipe, and adapted to be supported by a wall box mounting bracket.
Figure 15:
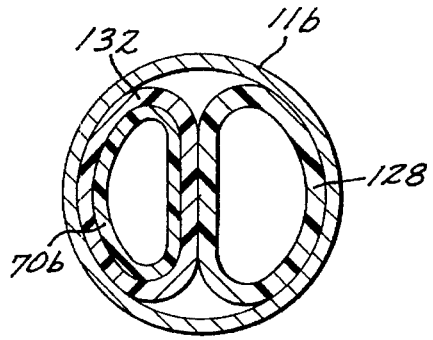
FIG. 15 is a view taken along the line 15—15 of FIG. 14.

In FIGS. 14 and 15 an air gap device is illustrated which is particularly adapted to fit within a smaller drain standpipe 11*b*. The standpipe 11*b* is approximately 1½ inches in diameter, compared to the two inch standpipe 11 described in connection with the previous embodiments.

The arrangement does not use a clamping element 122. In addition, the outlet end of the thermoplastic air gap device is preferably made generally oval in shape. This is done by heating the end to soften it for shaping.

The resulting shaped outlet end 70*b* is frictionally forced into a short length of resilient flexible hose 132. The two are securely held together by their tight interfitting relation. This can be enhanced by forming the outlet end 70*b* with a slight reverse taper to prevent its inadvertent or easy separation from the hose. Also, if the hose 132 used is of generous wall thickness and includes an internal or embedded cording, it will even more tightly grip the end 70*b*, and resist being pulled out of the standpipe. An added advantage of such a hose 132 is that it is not likely to collapse completely and block water flow when it is wedged into the standpipe next to the washing machine hose.

The generally oval form of the portion 70*b* also makes it easier to accommodate the generally oval shape assumed by the washing machine hose when it is forced into the standpipe, as seen in FIG. 15. When the hose 128 is made of aluminum instead of flexible rubber or plastic it is desirable to deform the aluminum into an oval shape for a better fit.

The resilient hose 132 firmly holds the lower end of the portion 70*a* in position.

The rectangular upper portion of the air gap device 42*b* is held in position by a wall box mounting bracket 134.

The bracket 134 includes a rectangular base 136 which includes openings at its corners for receiving four screws 138 to secure the base 136 to the back wall of the wall box 106. The base 136 also includes four elongated, flat sided arms 140 adjacent the screws.

The arms 140 are dimensioned to closely receive the short flat sides 62 of the rectangular body 56. The rectangular body 56 is positioned as far back in the wall box as the size of the wall box and the position of the hose 132 in the standpipe permits. This rearward location of the body 56 facilitates insertion of the washing machine hose 128 through the front of the wall box and into the standpipe.

After this positioning is done, the body 56 is glued in an upright position to the arms 140 by any suitable adhesive.

From the foregoing it can be seen that the present air gap anti-siphon system is adapted to provide both high and low flow rate drainage of various household water treatment devices.

While several forms of the invention have been illustrated and described, it will be apparent that various modifications can be made without departing from the spirit and scope of the invention.

I claim:

1. In an air gap anti-siphon system for drainage of waste water from a water treatment system into a drain line, wherein the flow of waste water may be relatively slow or relatively rapid and turbulent, and wherein the system includes a cylindrical stream modifier having an inner wall defining an elongated stream passage having an upper extremity for receiving a flow of waste water, a lower extremity for discharging the flow toward the drain line, and a plurality of vertically oriented, radially inwardly extending fins having outer edges attached to the inner wall and inner edges defining a vertically extending space; and an anti-siphon device having a body which forms a chamber defining a path for a flow of waste water from the stream modifier, the body having at least one air gap opening into the chamber, a discharge opening from the chamber, and downwardly and inwardly sloping walls adjacent the discharge opening for gathering and smoothly directing the flow out of the chamber; the improvement comprising:

a disk having a central opening which is relatively small compared to the internal diameter of the stream modifier to collect a relatively slow drip flow of reverse osmosis waste water, the disk being disposed across the upper extremity of the stream passage; and a tube fitted in fluid tight relation through the central opening and the vertically extending space to shape any waste water collected above the disk into a well defined stream for passage past the air gap opening.

2. In an air gap anti-siphon system for drainage of waste water from a water treatment system into a drain line, wherein the flow of waste water may be relatively slow or relatively rapid and turbulent, and wherein the system includes a cylindrical stream modifier having an inner wall defining an elongated stream passage having an upper extremity for receiving a flow of waste water, a lower extremity for discharging the flow toward the drain line, and a plurality of vertically oriented, radially inwardly extending fins having outer edges attached to the inner wall and inner edges defining a vertically extending space; and an anti-siphon device having a body which forms a chamber defining a path for a flow of waste water from the stream modifier, the body having at least one air gap opening into the chamber, a discharge opening from the chamber, and downwardly and inwardly sloping walls adjacent the discharge opening for gathering and smoothly directing the flow out of the chamber; the improvement comprising:

a disk having a central opening which is relatively small compared to the internal diameter of the stream modifier to collect a relatively slow drip flow of reverse osmosis waste water, the disk being disposed across the lower extremity of the stream passage; and a tube fitted in fluid tight relation through the central opening and the vertically extending space to shape any waste water collected above the disk into a well defined stream for passage past the air gap opening.

3. In an air gap anti-siphon system for drainage of waste water from a water treatment system into a drain line in which a washing machine discharge conduit is inserted, wherein the system comprises an anti-siphon device including a body having an air gap opening, a lower extremity having an oval shape, and a discharge opening from the body for discharge of waste water from the lower extremity, the improvement comprising;

a length of resilient hose slidably fitted over the lower extremity, the hose being radially compressible to slidably and resiliently fit into the upper end of the drain pipe in wedging relation to the washing machine discharge conduit whereby neither the resilient hose nor the discharge conduit can be removed from the dram pipe without deliberate effort.

4. The improvement in the air gap anti-siphon system according to claim 3 wherein the lower extremity is characterized by a cross section of generally oval shape.

5. The improvement in the air gap anti-siphon system according to claim 3 wherein the length of resilient hose is constructed and configured to resist collapse sufficient to close the waste water path through it upon insertion adjacent the washing machine discharge conduit.

6. In an air gap anti-siphon system for drainage of a stream of waste water from a water treatment system into a drain line, wherein the system comprises an air gap body including an upper extremity, a lower extremity, and a waste water flow passage between the upper extremity and the lower extremity, the waste water flow passage having an air gap opening to atmosphere, the system further comprising a stream modifier upstream of the air gap body for receiving the stream of waste water and discharging it into the air gap body, the stream modifier being characterized by an upper end, a lower end, a nozzle at the lower end, and a stream passage between the upper end and the lower end; the improvement comprising:

a plurality of vertically oriented means disposed within the stream passage of the stream modifier and defining a plurality of vertical passages that promote laminar flow through the stream passage of rapidly flowing waste water from the water treatment system, the vertically oriented means further defining a vertically extending central space;

means for modifying the stream modifier to collect slowly flowing waste water and shape it into a relatively small, uniform stream for discharge out of the nozzle, the means comprising:

a disk which is unapertured except for a central opening, and which is relatively small compared to the internal diameter of the stream passage of the stream modifier, the disk being disposed across the upper end of the stream modifier for collecting the waste water; and a tube closely fitted through the central opening in the disk and through the central space of the stream modifier, and providing a reduced stream passage to shape any waste water collected above the disk into a well defined stream for passage past the air gap opening.

7. The improvement in the air gap anti-siphon system according to claim 6, wherein the disk is disposed across the upper extremity of the stream passage.

8. The improvement in the air gar anti-siphon system according to claim 6, wherein the disk is disposed across the lower extremity of the stream passage.

9. The improvement in the air gap anti-siphon system according to claim 6, wherein the lower extremity of the air gap body includes downwardly and inwardly sloping walls, and including a collector bowl located downstream from the downwardly and inwardly sloping walls, and characterized by a conical inner surface for collecting and smoothly directing the flow of waste water from the air gap body for discharge into relatively signal diameter tubing.

10. The improvement in the air gap anti-siphon system according to claim 6 wherein the lower extremity of the air gap body includes downwardly and inwardly sloping walls having diverter openings for laterally diverting any back-flowing waste water through the walls to the atmosphere.

11. The improvement in the air gap anti-siphon system according to claim 6 wherein the lower extremity of the air gap body includes downwardly and inwardly sloping walls having openings forming diverter passages operative to laterally shunt any backflowing waste water which may flow upwardly into the waste water flow passage of the air gap body.

12. The improvement in the air gap anti-siphon system according to claim 6 in combination with a drain pipe and a smaller discharge conduit having a lower end located in the drain pipe, wherein the air gap body includes a lower extremity for receiving waste water discharge from the waste water flow passage, the lower extremity being generally oval shaped for location immediately above the lower end of the discharge conduit, and including a relatively short length of resilient hose slidably fitted over the oval shaped lower extremity, the hose being radially compressible into a generally oval shape to slidably and resiliently fit into the upper end of the drain pipe adjacent the lower end of the discharge conduit.

13. The improvement in the air gap anti-siphon system according to claim 12 and including a wall bracket adapted to be attached to fixed structure for support, and having arms extending from the wall bracket for attachment to the air gag body for supporting the body in a predetermined position.

14. The improvement in the air gap anti-siphon system according to claim 12 wherein the lower extremity of the air gap body has a cross section of generally oval shape.

15. In an air gap anti-siphon system comprising an air gap body which includes a waste water flow passage having an air gap opening to atmosphere, the improvement comprising:

stream modifying means located upstream other air gap body for shaping waste water flow into the air gap body into a well defined stream for passage past the air gap opening without splattering of water out of the air gap opening, the stream modifying means including an upper end for receiving waste water, a lower end having a discharge nozzle, and an inner wall mounting a plurality of vertically oriented, radially towardly extending and circumferentially spaced apart fins having outcr and inner edges, the outer edges being attached to the inner wall and thereby defining a plurality of vertically oriented laminar flow passageways between the fins which form a first flow path for relatively high rates of waste water flow, the inner edges terminating centrally In spaced apart relation to define a vertically extending central passageway adapted to receive a tube for forming a second flow path for relatively low rates of waste water flow.

* * * * *